US006612572B1

(12) United States Patent
Mohr et al.

(10) Patent No.: US 6,612,572 B1
(45) **Date of Patent: *Sep. 2, 2003**

(54) METHOD AND DEVICE FOR CORRECTING GAPS IN BETWEEN TRANSMISSIONS

(75) Inventors: Keven Mohr, Constance (DE); Armin Zimmermann, Constance (DE)

(73) Assignee: Siemens Aktiengesellschaft, München ( * ) Notice: Subject to any disclaimer, the term of this patent is extended or adjusted under 35 U.S.C. 154(b) by 0 days.

This patent is subject to a terminal disclaimer.

(21) Appl. No.: 10/048,620

(22) PCT Filed: Apr. 28, 2000

(86) PCT No.: PCT/DE00/01344

§ 371 (c)(1),
(2), (4) Date: Feb. 4, 2002

(87) PCT Pub. No.: WO01/09018

PCT Pub. Date: Feb. 8, 2001

(30) Foreign Application Priority Data

Aug. 3, 1999 (DE) ..... 199 36 369

(51) Int. Cl.[7] ..... B65H 29/12
(52) U.S. Cl. ..... 271/280; 271/270; 271/281
(58) Field of Search ..... 271/280, 281, 271/258.01, 259, 172, 270, 272, 273, 202, 203; 198/460.1, 460.3; 209/900, 584, 656, 657

(56) References Cited

U.S. PATENT DOCUMENTS

| | | | | |
|---|---|---|---|---|
| 3,815,897 A | | 6/1974 | Hoehl et al. | |
| 4,451,027 A | * | 5/1984 | Alper | 271/10.02 |
| 5,083,769 A | * | 1/1992 | Young, Jr. | 271/280 |
| 6,443,448 B1 | * | 9/2002 | Mohr et al. | 271/270 |

FOREIGN PATENT DOCUMENTS

| | | |
|---|---|---|
| DE | 41 29 135 A1 | 3/1992 |
| DE | 196 42 350 C1 | 10/1997 |

* cited by examiner

*Primary Examiner*—Donald P. Walsh
*Assistant Examiner*—Kaitlin Joerger
(74) *Attorney, Agent, or Firm*—Young & Thompson

(57) ABSTRACT

Method for correcting gaps between mail items Given that the actual gaps b of a mail stream are smaller than the minimum gaps c which are required for processing, every xth mail item, where x=(a+b)/(c−b), with a=the average mail item length, is ejected. The mail stream is then divided by alternately supplying the mail items to two gap-correcting units, in which said mail items are shifted to the ejection gaps in such a way that the required minimum gaps are attained after both partial mail streams have been combined.

6 Claims, 2 Drawing Sheets

METHOD AND DEVICE FOR CORRECTING GAPS IN BETWEEN TRANSMISSIONS

CROSS REFERENCE TO RELATED APPLICATION

This is the 35 USC 371 national stage of International Application PCT/DE00/01344 filed on Apr. 28, 2000, which designated the United States of America.

FIELD OF THE INVENTION

The invention relates to a method and a device for correcting gaps between mail items.

BACKGROUND OF THE INVENTION

In the course of processing mail items, such as letters, postcards and the like for example, in larger mail distribution centers, the mail items frequently pass through a number of processing machines, in particular sorting machines, in succession, which machines are connected to one another using transport means. It is often the case here that the upstream machines have a higher throughput than the following ones.

If, for example, an upstream device for address reading, with a processing rate of 4 m/s given an average mail item length of 200 mm and an average gap of 106 mm, has a higher throughput than a following precision distribution machine having a processing rate of 3.2 m/s with a required gap of 70 mm, then the gap would have to be corrected for the precision distribution machine since following the jump in speed only gaps of 45 mm on average are produced. An average of 25 mm is therefore missing per gap. In order to create the required gaps, the mail items must be shifted back. In existing correction devices, this is performed by slowing down the mail items and speeding them up again by means of variable-speed roller pairs.

To attain a gap of 70 mm, the first mail item must be shifted back by 25 mm. A gap of only 20 mm is therefore produced behind this mail item. The second mail item then needs to be shifted back by 50 mm. If the second mail item is again followed by an average gap, then the second mail item would be pushed onto the third mail item. To avoid this, a large gap would have to occur every 3 mail items, that is to say a mail item must be removed from the mail stream. This would greatly reduce throughput however.

SUMMARY OF THE INVENTION

The object of the invention is therefore to increase too small gaps in a mail stream in such a way that as few as possible mail items must be removed from the supplied mail stream.

As a minimum requirement here, only as many mail items are ejected from the supplied mail stream as are required to increase the gaps, it being possible to perform said ejection at least partially within an upstream processing process. Mail items are prevented from being pushed on top of one another by dividing the mail stream between two gap-correcting units. Owing to the large spacings between the mail items in the gap-correcting units, the mail items can be shifted to the required extent without the mail items being pushed on to each other prematurely. Both partial streams are subsequently combined into one mail stream, with the gaps between the mail items corresponding to at least the required specified gaps.

It is advantageous to feed back the ejected mail items and reinsert them into the mail stream.

BRIEF DESCRIPTION OF THE DRAWINGS

The invention is described in greater detail below with reference to an exemplary embodiment.

DETAILED DESCRIPTION OF THE INVENTION

Figure 1:
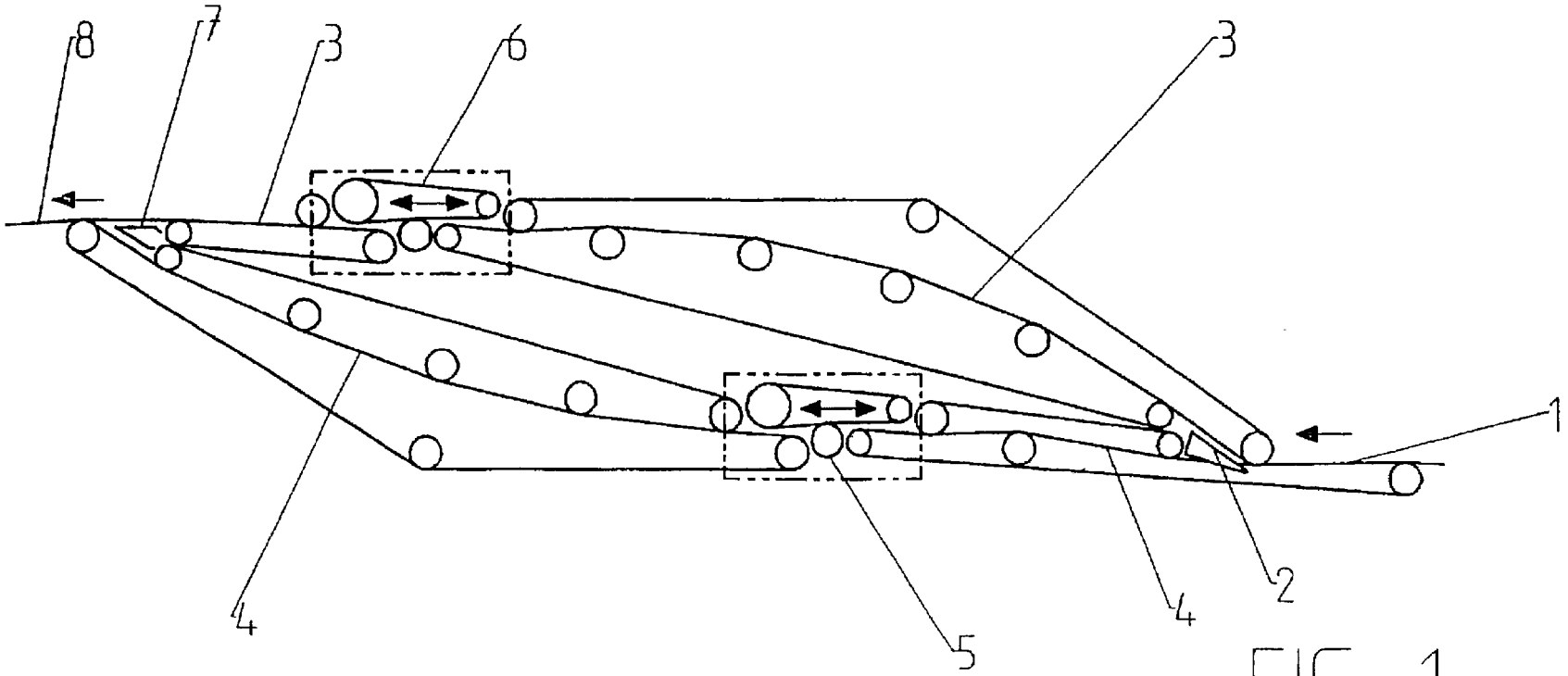
FIG. 1 shows a schematic representation of the correction device.

The transport means 3,4 which supply the mail items to the gap-correcting units 5,6 and transport said mail items away from said units are designed as sandwich conveyor systems (FIG. 1). Such a sandwich conveyor system comprises two parallel belts guided over transport and drive rollers. The mail items are clamped fast between the belts and transported. The mail items arriving by means of an infeed sandwich conveyor system 1 are divided between the two gap-correcting units 5,6 by means of a diverter 2 having a controlled movable distribution element.

Following the gap-correcting units 5,6, the two partial mail streams transported using the transport means 3,4 are combined in a combining device 7. The mail items are subsequently transported further by an outfeed sandwich conveyor system 8.

The gap-correcting units 5,6 have in each case a variable-speed short sandwich conveyor system in which the mail items are slowed down and speeded up again. The ejection of individual mail items required for the process is performed in an upstream stage not illustrated in FIG. 1. The gap-correcting units 5,6 and the diverters for diverting 2 and ejecting the mail items are controlled by a control unit, not shown, with the position of the mail items being continuously determined by means of sensors, for example light barriers, for a given transport speed.

Figure 2:
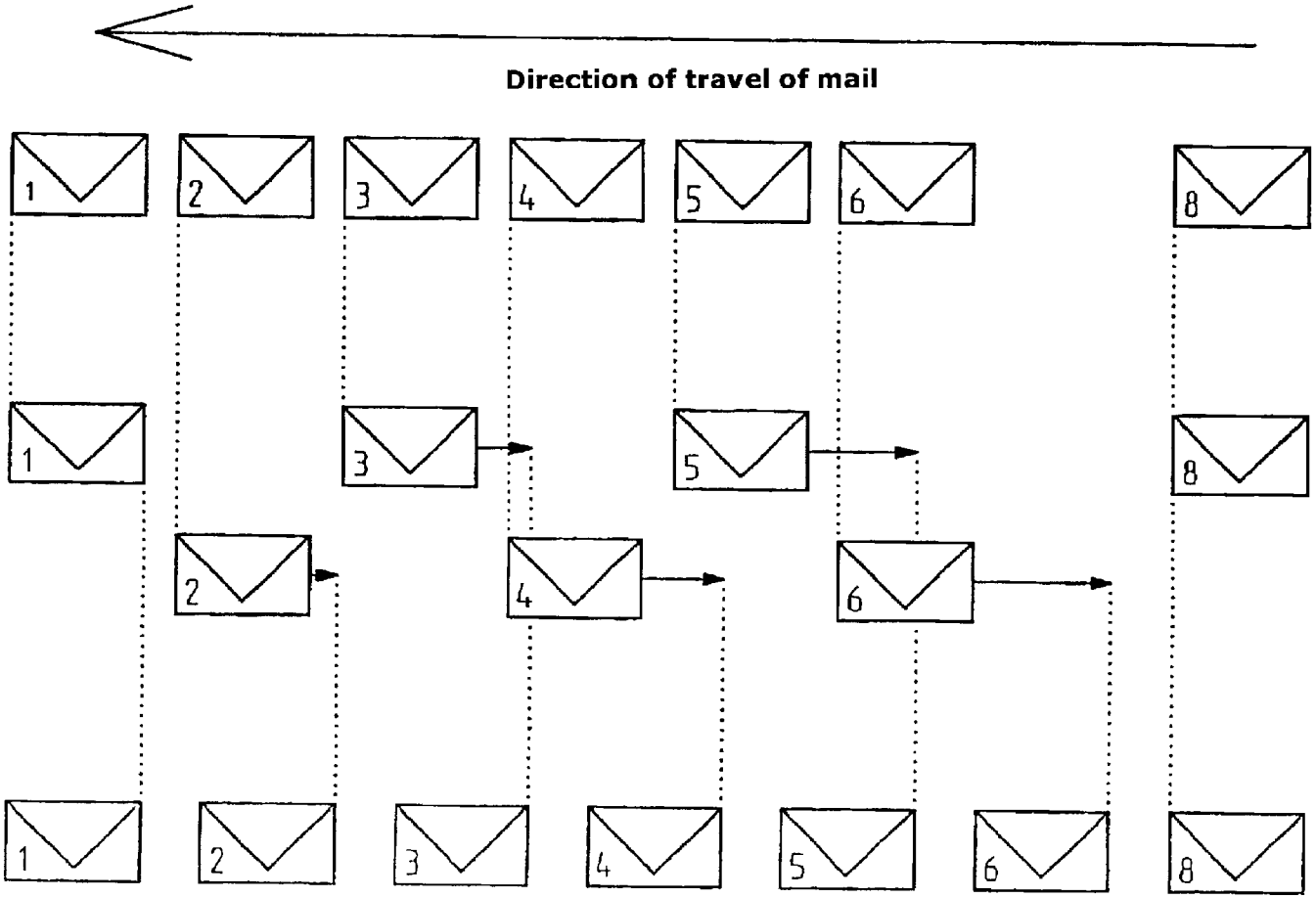
FIG. 2 illustrates schematically the sequence of gap enlargement from a mail stream with ejected mail items.

The procedure for increasing the gaps between the mail items of a mail stream is illustrated schematically in FIG. 2. From the incoming letter stream having an average mail item length of a and too small an average actual gap b with a minimum gap c required for processing, every xth mail item, where $x=(a+b)/(c-b)$, is ejected, in this example every 7th mail item.

The mail stream is subsequently divided into two partial mail streams by alternately supplying the mail items to the two gap-correcting units 5,6, that is to say the mail items having the numbers 1, 3, 5 (i.e. the sixth, the fourth and the second mail item before the ejected mail item no. 7 in the direction of travel of the mail) reach one gap-correcting unit 5, and the mail items nos. 2, 4 and 6 (i.e. the fifth, the third and the first mail item before the ejected mail item no. 7 in the direction of travel of the mail) reach the other gap-correcting unit 6. The length of the arrows indicates the distance by which it is necessary to shift the respective mail item back. The relative position of the leading mail item no. 1 is not changed. The mail item no. 2 on the other path is shifted back by the difference between the minimum and the actual gap. The mail item no. 3 is in the path of the mail item 1 and must be shifted back by twice the difference between the minimum and the actual gap so that the minimum gap is attained between mail items nos. 2 and 3 after the partial mail streams have been combined.

In turn, the mail item no. 4 must be shifted back by three times the difference between the minimum and the actual gap, etc.

As can be seen, the division of the mail stream, and the resulting large gaps between the mail items, prevent the mail items being pushed over one another. Once the partial mail streams have been combined, the mail stream uniformly exhibits the minimum gaps between the mail items.

What is claimed is:

1. A method for correcting gaps between mail items of a mail stream which is supplied to a mail processing unit, where the average actual gap b of the mail stream is smaller than the average minimum gap c which is required for processing in the mail processing unit for the selected mail stream speed, comprising the steps of:

ejecting at least every xth mail item, where $x=(a+b)/(c-b)$ for an average mail item length a;

diverting the mail stream by alternately supplying the mail items to two gap-correcting units and, after they have passed through the gap-correcting units, combining the separated partial mail streams into one mail stream; and shifting the mail items located before the gaps produced by the ejecting step back against the direction of transport in the gap-correcting units, beginning with the (x−1)th mail item before the ejected mail item, in such a way that between the successive mail items of the recombined mail stream the gaps are greater than or equal to the minimum gap c.

2. The method as claimed in claim 1, wherein the ejected mail items are fed back and reinserted into the mail stream.

3. A device for correcting gaps between mail items of a mail stream which is supplied to a mail processing unit, where the average actual gap b of the mail stream is smaller than the average minimum gap c between the mail items which is required for processing in the mail processing unit for the selected mail stream speed, the mail items in the mail stream having a mail item-size gap every xth mail item, where $x=(a+b)/(c-b)$ for an average mail item length a, the device comprising:

a diverter for dividing the mail stream between two transport means which supply the mail items to respective gap-correcting units and transport said mail items away from said units in each case;

a combining unit for combining the partial mail streams; and at least one control unit for controlling the diverter in such a way that the mail items of the mail stream are alternately divided between the gap-correcting units, and for controlling the gap-correcting units in such a way that the mail items located before the mail item-size gaps are shifted back against the direction of transport in ht gap-correcting units, beginning with the (x−1)th mail item before the mail item-size gap, in such a way that between the successive mail items of the recombined mail stream the gaps are greater than or equal to the minimum gap.

4. In a device for correcting gaps between mail items with an average mail item length a in a mail stream that is sent to a mail processing unit, where an average actual gap b between the mail items in the mail stream is smaller than an average minimum gap c between the mail items that is required in the mail processing unit, where every xth mail item has been ejected from the mail stream to create spaces in the mail stream before the mail stream reaches the device, the improvement comprising:

a diverter in the mail stream that divides the mail stream alternately into two sub-streams;

two gap-correcting units, one for each of said two sub-streams, each of said gap-correcting units adjusting a gap between the mail items in the respective one of said sub-streams so that the mail items are shifted back against a direction of movement beginning with the (x−1) mail item before a respective one of the spaces so that successive mail items in a combined mail stream are separated by gaps that are at least the minimum gap c, where $x=(a+b)/(c-b)$; and a combining unit that receives said sub-streams from said gap-correcting units and forms the combined mail stream that is sent to the mail processing unit.

5. The improved device of claim 4, wherein a first of said gap-correcting units changes a gap between the (x−1) and (x−2) mail items by an amount less than a second of said gap-correcting units changes a gap between the (x−2) and (x−3) mail items.

6. The improved device of claim 4, wherein a first of said gap-correcting units does not change a gap between the (x−1) and (x−2) mail items, and the a second of said gap-correcting units changes a gap between the (x−2) and (x−3) mail items by an amount less than said first gap-correcting unit changes a gap between the (x−3) and (x−4) mail items.

* * * * *